United States Patent [19]

Getselev

[11] 4,014,379

[45] Mar. 29, 1977

[54] METHOD OF FORMING INGOT IN PROCESS OF CONTINUOUS AND SEMI-CONTINUOUS CASTING OF METALS

[76] Inventor: Zinovy Naumovich Getselev, prospekt Metallurgov, 73, kv. 29, Kuibyshev, U.S.S.R.

[22] Filed: July 3, 1972

[21] Appl. No.: 268,689

Related U.S. Application Data

[63] Continuation of Ser. No. 44,752, June 9, 1970, abandoned.

[52] U.S. Cl. ..... 164/4; 164/49; 164/82

[51] Int. Cl.[2] ..... B22D 11/02; B22D 27/02

[58] Field of Search ..... 164/4, 49, 82, 154, 164/155, 250

[56] References Cited

UNITED STATES PATENTS

| | | | |
|---|---|---|---|
| 3,243,493 | 3/1966 | Bunshah et al. | 164/49 UX |
| 3,467,166 | 9/1969 | Getselev et al. | 164/49 |
| 3,478,808 | 11/1969 | Adams | 164/4 |
| 3,519,060 | 7/1970 | Vischulis | 164/155 |

OTHER PUBLICATIONS

The International Dictionary of Physics and Electronics, D. Van Nostrand Co. Inc., 1956, QC 515 c.12 p. 328.

*Primary Examiner*—Robert D. Baldwin
*Attorney, Agent, or Firm*—Holman & Stern

[57] ABSTRACT

A method of forming an ingot in the process of continuous and semi-continuous casting of metals consisting in that the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down.

2 Claims, 2 Drawing Figures

INVENTOR
Zinovy Naumovich Petsalev

Holman, Glascock, Downing & Seebold
ATTORNEYS

METHOD OF FORMING INGOT IN PROCESS OF CONTINUOUS AND SEMI-CONTINUOUS CASTING OF METALS

This is a continuation of application Ser. No. 44,752, filed June 9, 1970, now abandoned.

The present invention relates to methods of controlling the processes of casting of metals and, more specifically, the invention relates to a method of forming an ingot in the process of continuous and semi-continuous casting of metals.

Known in the art is a method of forming an ingot during the continuous and semi-continuous casting of metals by acting upon moltent metal by an electromagnetic field of an inductor, which operation is followed by cooling of the ingot. (cf. British pat. No. 1,157,977 of 1969).

However, the known method of forming the ingot does not provide for keeping constant transverse dimensions of the ingot in spite of fluctuations of the level of the surface of the liquid zone of the ingot occuring during the initial period of casting and in the process of casting due to various external disturbances caused, for example, by non-smooth movement of the pan of a casting machine, or incorrect operation of the system for automatic level control.

The basic object of the invention is to develop a method of forming an ingot in the process of continuous and semicontinuous casting of metals which provides for constant transverse dimensions of the ingot despite fluctuations of the surface level of the liquid zone of the ingot.

According to this and other objects the essence of the invention comprises a method of forming the ingot during the continuous and semi-continuous casting of metals, according to the invention, in which the magnitude of the current flowing through the inductor is controlled as a function of the deviations of the size of the liquid zone of the ingot from a prescribed value.

It is preferred to control the current by a direct negative voltage feedback signal taken directly from the inductor.

Furthermore it is expedient to measure the level of the liquid zone of the ingot, to transform the obtained value into an electric signal acting upon the current, flowing through the inductor, in such a direction so as to provide for keeping the prescribed transverse dimensions of the liquid zone of the ingot.

Other objects and advantages of the invention will be apparent from the following detailed description of one particular embodiment of the invention, reference being made to the accompanying drawings, in which.

Figure 1:
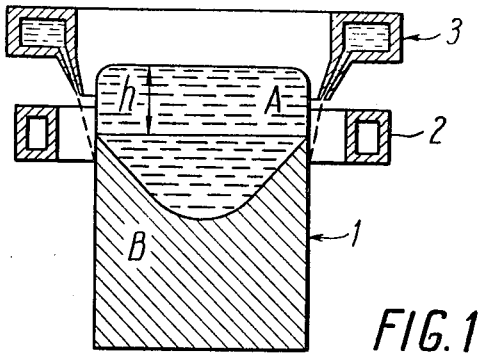
FIG. 1 is a schematic vertical sectional view showing an ingot in the electromagnetic field of an inductor.

Shown in FIG. 1 is an ingot, generally designated by reference numeral 1 formed by the electromagnetic field of an annular inductor 2. The ingot is cooled by means of a cooling system 3 feeding a cooling medium.

The ingot has a liquid zone A and a solidified zone B, the height of the liquid zone being marked in the drawing by a symbol $h$.

By means of the annular electromagnetic inductor 2 an alternating electromagnetic field is excited around the molten metal fed to the ingot forming zone, which field produces forces within the molten metal which are directed into this metal and form it. In this case the molten metal acquires shape and size in the cross section prescribed and determined by the current flowing through the inductor. A cooling liquid is fed onto the lateral surface of the metal column formed by the electromagnetic field so that the metal is partially solidified within the zone of action of the electromagnetic field and then, while moving, completely solidifies, thus forming an ingot.

The transverse dimensions of the ingot which define to the predetermined value thereof depend on the electromagnetic pressure (current of the inductor 2) and on the metallostatic pressure (the height h of the liquid zone A of the ingot 1).

The prescribed dimensions of the ingot take place if the elctromagnetic pressure is equal to the metallostatic pressure. The state of equilibrium is characterized by the following equality $$\gamma g h = K I^2 \qquad (1)$$

where;

$\gamma$ is the metal density, $g$ is the gravitational acceleration, $h$ is the height of the liquid zone, $K$ is a factor taking into account the geometrical parameters of the system, the conductivity of the metal and the current frequency, and $I$ is the inductor current.

When fluctuations of the level of the liquid zone of the ingot (changes in height h) occurs caused by any external disturbances, the transverse dimensions of the ingot are changed. Thus, an increase of the height of the liquid zone at a constant current of the inductor results in an increase of the transverse dimensions of the ingot, as in this case the metallostatic pressure exceeds the electromagnetic pressure. The dimensions of the ingot will increase until the equality (1)is again accomplished.

When fluctuations of the height and dimensions of the liquid phase occur the electric parameters of the inductor-molten metal system are changed. For example, if the height of the liquid zone is increased relative to its dimensions, the total resistance of the inductor-molten metal system is reduced. As a result, if the voltage on the inductor is maintained constant, the inductor current is increased interfering with an increase of the ingot dimensions.

Thus, there is obtained a partial stabilization of the ingot dimensions at fluctuations of the liquid zone level. But for this purpose it is necessary to stabilize the voltage on the inductor terminals. The stabilization of the voltage is effected by means of a direct negative feedback.

However, the stabilization of the voltage on the inductor does not always provide for required constant transverse dimensions of the ingot. In these cases, in order to provide for the required dimensions of the ingot, the inductor current is preferably corrected by a value determined by the deflection of the level of the liquid zone from a prescribed value.

Figure 2:
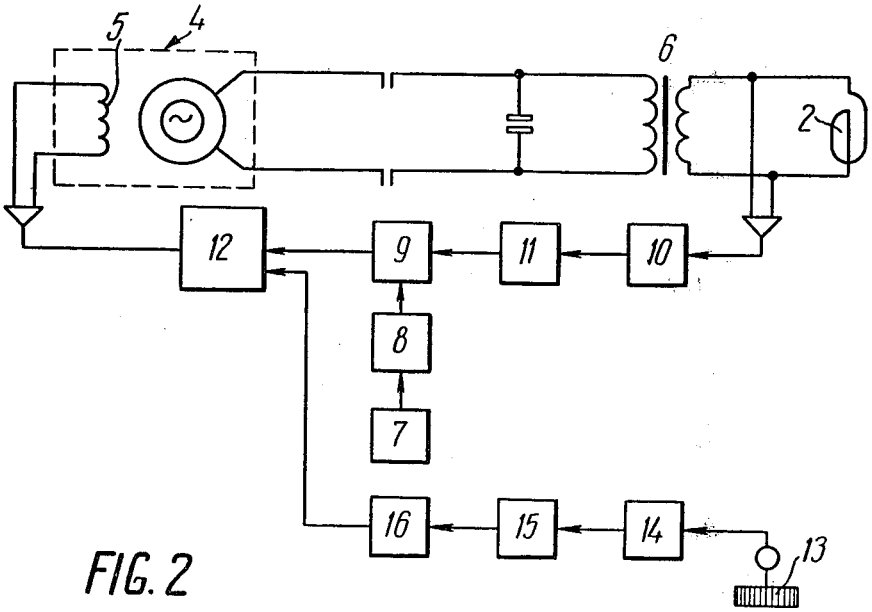
FIG. 2 shows a block circuit diagram of a preferred apparatus for effecting the method according to the invention.

Shown in FIG. 2 is a block circuit diagram of a preferred apparatus for effecting the method of forming the ingot. The apparatus comprises an electromagnetic inductor 2 connected to a frequency changer 4 with a field winding 5 through a stepdown transformer 6, a voltage setter 7 for setting the voltage on the inductor connected through a rectifier 8 to one of the inputs of an adding device 9, a meter 10 for measuring the voltage of the terminals of the inductor 2 connected through a rectifier 11 to the other input of the adding device 9, a power amplifier 12 whose output is connected to the field winding 5 of the frequency changer, a liquid zone level indicator 13 connected to a phase-sensitive amplifier 15 through a converter or transducer 14 which converts the level value into an electric signal. The phase-sensitive amplifier 15 is connected to a functional modular unit 16 associated with the input of the power amplifier 12. The other input of the amplifier 12 is connected with the output of the adding device 9. The meter 10 for measuring the voltage on the terminals of the inductor 2 may be built around a transformer, the adding device 9 may be based on a magnetic amplifier and the level indicator 13 may simply comprise a float.

The functional modular unit 16 may be built around a linear multisectional potentiometer providing for fulfilment of the dependence $$\Delta I = K_1 \ \Delta h \qquad (2)$$

where:

$\Delta I$ is an increment of the inductor current $\Delta h$ is a deflection of the level of the liquid phase from a prescribed values $K_1$ is a constant of proportionality.

The (2) is a linear approximation of the equality (1) previously described and is accepted due to the fact that in practical conditions the deviations ($\Delta h$) of the height of the liquid zone are sufficiently low. In this case the factor $K_1$ depends on the selected working section on the curve built in accordance with the equality (1).

The stabilization of the voltage on the terminals of the inductor 2 is effected by means of a direct negative feedback, i.e. the signal from the output of the meter 10 for measuring the voltage on the inductor through the rectifier 11 is applied to one of the inputs of the adding device 9, whose other input is fed with a signal from the output of the voltage setter 7 through the rectifier 8, said latter signal corresponding to the required voltage on the inductor 2; the error signal from the output of the adding device 9 is fed to the power amplifier 12 loaded to the field winding 5 of the frequency changer 4 feeding the inductor 2.

The control of the current of the inductor 2 is effected as follows. The signal from the output of the level detector 13, proportional to the deviation of the level of the liquid zone from the prescribed value, is fed to the converter 14 transforming the level displacement into an electric signal and then the signal is applied to the input of the phase-sensitive amplifier 15, the output of which through the functional unit 16 is associated with the input of the power amplifier 12 loaded by the field winding 5 of the frequency changer 4 feeding the electromagnetic inductor 2.

The advantage of the proposed method of forming the ingot in the process of continuous and semi-continous casting of metals comprises the provision of a high accuracy of the transverse dimensions of the ingot despite fluctuations of the level of the liquid zone, and this is particularly important when casting the ingots from high-heat metals, for example steel, the ingots having small cross sections and the ingots being formed at a high casting speed, as in these cases known control systems fail to provide for a required accuracy of control of the level of the liquid zone.

I claim:

1. A method of forming an ingot in the process of continuous and semi-continous casting of metals, which method comprises the steps of shaping the molten metal by an electromagnetic field of an inductor; adjusting the current flowing through the inductor depending on the deviations of the height of the liquid zone of the ingot from a prescribed level to maintain the prescribed transverse dimensions of the liquid zone wherein the level of said liquid zone of the ingot is measured, and the obtained magnitude is converted into an electrical signal which acts to adjust the current flowing through the inductor in the direction providing for the maintenance of the prescribed transverse dimensions of the liquid zone of the ingot; and thereafter cooling the molten metal until the molten metal is at least partially solidified.

2. The method as defined in claim 1, in which the adjustment of the current flowing through the inductor is effected by a direct negative voltage feedback signal taken directly from said inductor.

* * * * *